US007639471B2

(12) United States Patent
Telefont

(10) Patent No.: US 7,639,471 B2
(45) Date of Patent: Dec. 29, 2009

(54) ELECTRICAL CIRCUIT FOR A SELF-RETAINING RELAY

(75) Inventor: Heinz Telefont, Krems/Egelsee (AT)

(73) Assignee: Alcatel Lucent, Paris (FR)

( * ) Notice: Subject to any disclaimer, the term of this patent is extended or adjusted under 35 U.S.C. 154(b) by 73 days.

(21) Appl. No.: 11/693,557

(22) Filed: Mar. 29, 2007

(65) Prior Publication Data

US 2007/0230084 A1 Oct. 4, 2007

(30) Foreign Application Priority Data

Mar. 30, 2006 (EP) ..... 06290537

(51) Int. Cl.
*H01H 47/00* (2006.01)

(52) U.S. Cl. ..... 361/194

(58) Field of Classification Search ..... 361/194
See application file for complete search history.

(56) References Cited

U.S. PATENT DOCUMENTS 4,206,443 A * 6/1980 Britton ..... 340/3.43
4,679,116 A 7/1987 Oshizawa et al.
4,888,494 A * 12/1989 McNair et al. ..... 307/38

* cited by examiner

*Primary Examiner*—Stephen W Jackson
*Assistant Examiner*—Nicholas Ieva
(74) *Attorney, Agent, or Firm*—Sughrue Mion, PLLC

(57) ABSTRACT

An electrical relay circuit, comprising a load circuit with a series connection of a first generator (G1), a load component (R load) and a relay switch (S1) of a relay (RL1), wherein the relay switch (S1) has a closed position in which the load circuit is closed, and wherein the relay switch (S1) hat a magnetized position in which the load circuit is broken, further comprising an auxiliary circuit with a second generator (G2) for providing a control signal, wherein by means of the control signal the relay switch (S1) can be switched into the magnetised position, and wherein the auxiliary circuit keeps the relay switch (S1) in the magnetized position after the control signal is over, is characterized in that the first generator (G1) is connected to a series connection of the relay (RL1) and a constant current source (CCS) in both positions of the relay switch (S1), that the constant current source (CCS) is connected to an activation circuit (A) comprising the second generator (G2), wherein the constant current source (CCS) can be put into the activated state by the activation circuit (A) when the relay switch (S1) is in the closed position, and that the constant current source (CCS) is further connected to a holding circuit (H), wherein the holding circuit (H) keeps the constant current source (CCS) in the activated state when the relay switch (S1) is in the magnetised position. This simple, self-retaining relay circuit may be operated in a wide range of voltages.

8 Claims, 2 Drawing Sheets

ELECTRICAL CIRCUIT FOR A SELF-RETAINING RELAY

BACKGROUND OF THE INVENTION

The invention is based on a priority application EP 06 290 537.7 which is hereby incorporated by reference.

The invention relates to an electrical relay circuit, comprising a load circuit with a series connection of a first generator, a load component and a relay switch of a relay, wherein the relay switch has a closed position in which the load circuit is closed, with the closed position belonging to a currentless state of the relay, and wherein the relay switch hat a magnetized position in which the load circuit is broken, with the magnetized position belonging to a current-carrying state of the relay, further comprising an auxiliary circuit with a second generator for providing a control signal, wherein by means of the control signal the relay switch can be switched into the magnetised position, and wherein the auxiliary circuit keeps the relay switch in the magnetized position after the control signal is over.

Relays are used to switch load circuits which carry high electric currents, without a direct contact to the load circuit.

A typical relay comprises a relay switch, which is part of the load circuit, wherein the relay switch can be controlled by applying a current to a coil of the relay. The relay switch is biased into a first position, e.g. with a spring. The relay switch is in the first position when no or a low current is applied to the coil of the relay (=currentless state of the relay). In contrast, when the coil is carrying a sufficiently strong current, magnetic force generated by the coil puts the relay switch into a second position (=current-carrying state of the relay). The current needed to power the relay, i.e. the coil, is typically much less than the current of the load circuit switched.

Simple relay applications use a control signal directly for powering the relay. As long as the relay switch shall stay in the second (or magnetized) position, the control signal must be present. As soon as the control signal ceases, the relay switch goes back into the first (or default) position.

However, for some applications, in particular in railway safety engineering, it is useful to switch the state of a relay (and the position of the relay switch) permanently with a with a short (non-enduring) short pulse signal. For example, a relay switch is in the first (default) position. Upon a pulse of the control signal, the relay switch should change into the second, magnetized position and stay in the second position even after the control signal has ended. An electrical relay circuit, wherein the position of the relay switch changes upon a control signal and wherein the position of the relay switch is kept after the control signal has ended, is referred to as self-retaining.

In the state of the art, self-retaining relay circuits are known which use two relays, see FIG. 2 for details. A first relay, with a first relay switch being part of the load circuit, is powered by a first generator of the load circuit when the first relay switch is in the second position. A second generator may power a second relay with a second relay switch. When the second relay switch is in the magnetized position, the first relay is powered in the first position of the first relay.

However, the known self-retaining relay circuit needs two relays, making it rather space-consuming, complex and therefore expensive. More severe, the known self-retaining relay circuits can only be operated in a rather narrow range of voltages of the generator of the load circuit.

SUMMARY OF THE INVENTION

It is therefore the object of the invention to provide a simple, self-retaining relay circuit which may be operated in a wide range of voltages.

This object is achieved, in accordance with the invention, with an electrical relay circuit as introduced in the beginning, characterized in that that the first generator is connected to a series connection of the relay and a constant current source in both positions of the relay switch, wherein the constant current source allows the flow of a constant current through it when in an activated state, that the constant current source is connected to an activation circuit comprising the second generator, wherein the constant current source can be put into the activated state by the activation circuit when the relay switch is in the closed position, and that the constant current source is further connected to a holding circuit, wherein the holding circuit keeps the constant current source in the activated state when the relay switch is in the magnetised position.

According to the invention, the relay is powered via a constant current source connected to the first generator. The constant current source makes sure that the relay, i.e. the coil of the relay, gets fixed and sufficient power for switching the relay switch, even if the voltage of the first generator is varying over a wide range, even during regular operation. In other words, the relay does not de-energize over a wide range of operating voltages. The inventive self-retaining relay circuit is suitable for first generators providing direct current or alternating current, with minor modifications such as rectifying diodes. The constant current source can be realized with inexpensive standard electronic equipment, in particular less space-consuming than a second relay.

The constant current source is used both during the immediate switching of the relay switch, and at holding the relay. It can be activated (or kept activated) both by the control signal induced by the second generator as long as the relay switch is in the closed (or default) position, or by the holding circuit once the relay switch is in the magnetized position.

PREFERRED EMBODIMENTS OF THE INVENTION

In a highly preferred embodiment of the inventive electrical relay circuit, the constant current source comprises an optical coupler connected to a resistor and the basis of a transistor. This is a simple way to realize the constant current source. With the optical coupler, the potentials of the relay and the first generator are insulated against the potential of the second generator. This increases the safety.

Another preferred embodiment is characterized in that the activation circuit comprises a light emitting diode (=LED), coupled to an optical coupler. The LED is a reliable tool to activate the optical coupler, which is part of the constant current source.

In a preferred further development of these embodiments, the optic coupler comprises a darlington circuit, with a photocell connected to the basis of the darlington circuit. Alternatively, a darlington circuit can be used wherein the basis can be illuminated directly. The darlington circuit amplifies a photo current induced by a light source such as an LED belonging to the activation circuit.

In a modification of this further development, the photocell is connected to the basis of the darlington circuit via a power transistor, in particular an npn power transistor. This increases the available power for controlling the relay.

Another preferred embodiment of the inventive electrical circuit is characterized in that the holding circuit comprises a holding transistor connected to the constant current source via a resistor, with the basis of the holding transistor being connected to the relay via a resistor. This is a simple way to implement the holding circuit.

Particularly preferred is an embodiment wherein a capacity is connected in parallel to the auxiliary circuit. The capacity can compensate short-term variations of the voltage of the first generator so the relay does not de-energize, This is particularly useful in case of an alternating voltage of the first generator; then the capacity is chosen so high that during at least a full period of the AC voltage the relay does not de-energize.

Equally preferred is an embodiment wherein the auxiliary circuit is connected to the first generator via at least one diode. In case of an AC voltage at the first generator, the at least one diode rectifies the voltage in the auxiliary circuit.

Further advantages can be extracted from the description and the enclosed drawing. The features mentioned above and below can be used in accordance with the invention either individually or collectively in any combination. The embodiments mentioned are not to be understood as exhaustive enumeration but rather have exemplary character for the description of the invention.

BRIEF DESCRIPTION OF THE DRAWINGS

The invention is shown in the drawing.

FIG. 1 shows an electric relay circuit in accordance with the invention. A relay RL1 comprises a relay switch S1 and a magnet coil, i.e. a device for switching the relay switch S1. The relay switch S1 is part of a load circuit, with the load circuit comprising a first generator G1, a load component R load, and the relay switch S1. R load is e.g. a railway signal light. G1 provides an AC voltage of 24V. The electric relay circuit further comprises an auxiliary circuit, comprising the relay RL1 resp. its coil, an activation circuit A, a constant current source CCS, and a holding circuit H. Further, there are diodes D1, D2, D3 connecting the auxiliary circuit to the first generator G1, and a capacitor C1 connected in parallel to the auxiliary circuit with respect to G1.

Figure 1:
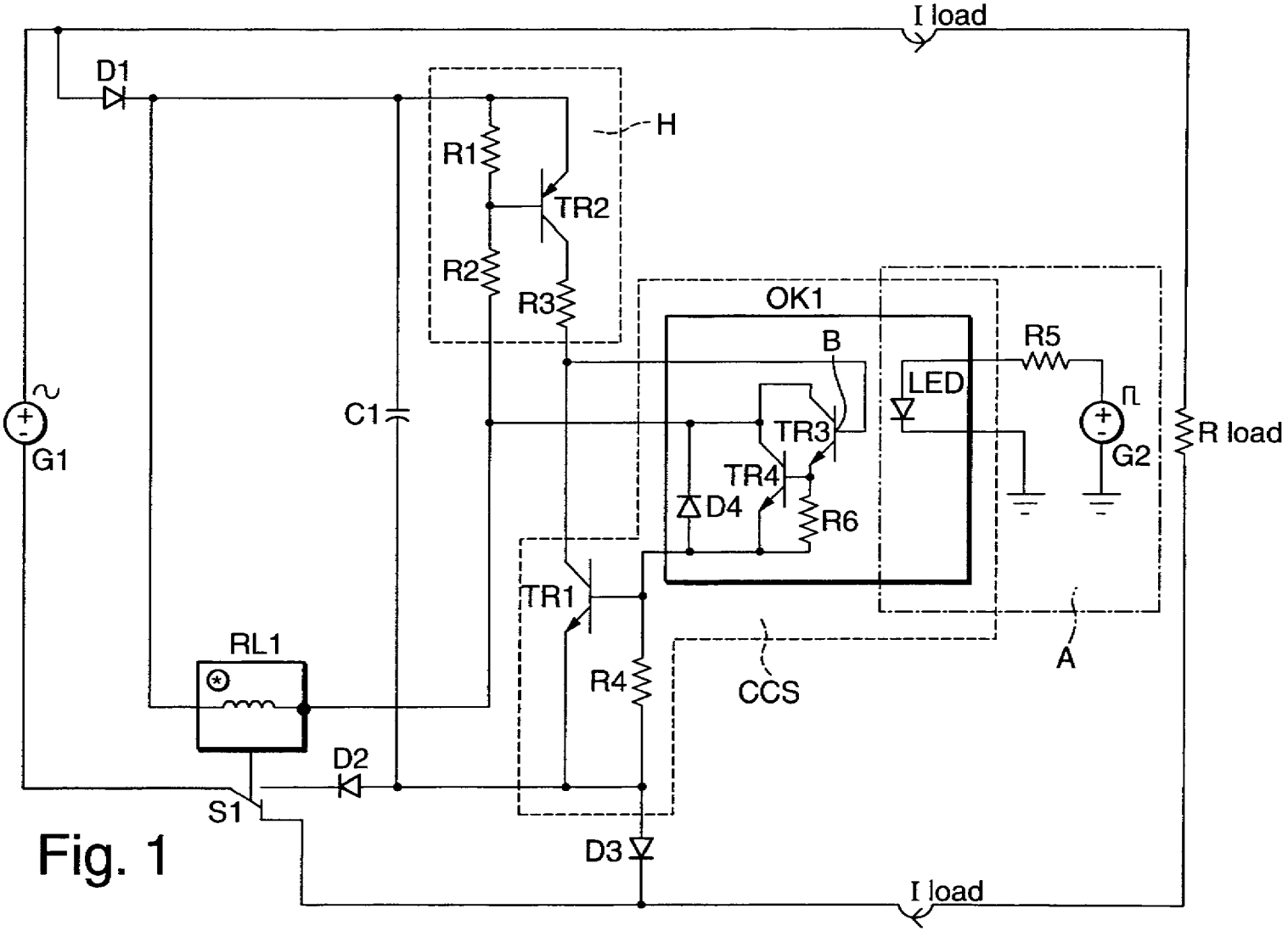
FIG. 1 shows a schematic circuit diagram of an inventive self-retaining relay circuit.

The relay switch S1 is shown in a first (or closed, unmagnetized) position in which the load circuit is closed, so an electric current I load runs through the load component R load. In this closed position of the relay switch S1, RL1 resp. its coil is in a currentless state. In particular, an optical coupler OK1 is of high resistance. The capacitor C1 is loaded up to its operating voltage via the diodes D1 and D3.

The electrical relay circuit, in particular relay switch S1, may be switched, in accordance to the invention, as described in the following.

The activation circuit A comprises a second generator G2, connected in series with a resistor R5 and a light emitting diode LED. G2 can generate a short pulse signal, e.g. one second in length with a peak voltage of 5V. This is enough to light the LED.

The LED is integrated into an optical coupler OK1. The optical coupler OK1 further comprises a darlington circuit of two coupled transistors TR3, TR4, and further a resistor R6 and a diode D4. The LED illuminates the basis B of the darlington circuit, i.e. the basis of upstream transistor TR3. This has the effect of inducing a photo current towards the basis B, making TR3 conductive. Alternatively, a photo cell may be put upstream of the basis B, and the LED illuminates said photo cell, what also would make TR3 conductive.

The optical coupler OK1, together with the transistor TR1 and resistor R4, form a constant current source CCS. The CCS is activated by making the transistor TR3 conductive between its collector and emitter, in particular by the above mentioned photo current. Upon activation of the CCS, an electric current I(RL1) runs through relay RL1 (and D1, CCS and D3). This current I(RL1) equals the voltage U(basis-emitter of TR1)/R4, and is independent of the voltage of G1. The current I(RL1) changes the state of the relay RL1 from currentless to current-carrying, and switches the relay switch S1 into the second (or magnetized) position. As a result, the load circuit is opened, and R load has no more current.

The current I(RL1) has also the effect of activating the holding circuit H. The holding circuit comprises the resistors R1, R2, R3 and transistor TR2. The transistor TR2 is switched on via resistors R2, R3. Via resistor R3, the CCS resp. basis B of OK1 is provided with a holding current. The holding current adds up to the photo current at basis B of OK1 during the remaining duration of the control signal, and replaces of the photo current entirely after the control signal of G2 ceases resp. after the LED has become dark. The holding current is high enough to keep the CCS operating (or activated), i.e. providing the constant current for RL1.

In case the output power of the darlington circuit is too small for controlling the relay RL1, a power transistor may be placed downstream of the darlington circuit (not shown).

After the relay switch has switched into the magnetized second position (upper position in FIG. 1), D2 takes over the function of D3 for connecting the auxiliary circuit, and in particular the holding circuit H and the CCS, to the first generator G1. As a result, the relay RL1 stays in its current-carrying state, and relay switch S1 in its magnetized position.

Since the auxiliary circuit keeps the operating current I(RL1) constant, and thus also the operating voltage of RL1 constant, the relay RL1 may be chosen with a relatively small operating voltage, such as 5V, 30 mA, whereas the operating voltage of the first generator G1 may be much higher, such as 24V. In order to adjust the voltage at the relay RL1, a limiting resistor may be connected in series with the relay RL1. Note that voltage variations of the first generator G1 can be tolerated, e.g. from 5V up to 24V, and the electric relay circuit still works, in particular the relay RL1 is still self-retaining.

The relay RL1 only de-energizes (and relay switch S1 goes back into the first, closed position it is pre-stressed towards) when the voltage of the first generator G1 is switched off, and the voltage at C1 has fallen below a switching level of the relay RL1.

In practice, the shown electrical relay circuit worked well with the following parameters:

G1 generates a 50 Hz AC signal between 5V and 24V,
R1, R2 have 100 kOhm each,
R3 has 10 kOhm,
R4 has 22.1 Ohm,
G2 generates a 5V pulse of 1 second length,
RL1 has an internal resistance of 15 Ohms,
C1 has 470 μF,
U(B-E) at TR1 was 0.65V, resulting in an I(RL1) of 29.4 mA.

In summary, the inventive electric relay circuit allows a control of the relay RL1 with a well-separated potential of G2,
a wide range of voltages of G1 can be tolerated, only one switching contact (and no auxiliary contacts) are necessary, G1 may be an AC source (as shown in FIG. 1) or a DC source (then the diodes D1, D2, D3 and capacitor C1 can be dispensed with), the relay RL1 may be chosen as a power relay and G1 as a net source, there is no significant power consumption in the inactive phase (when the load circuit is broken).

Figure 2:
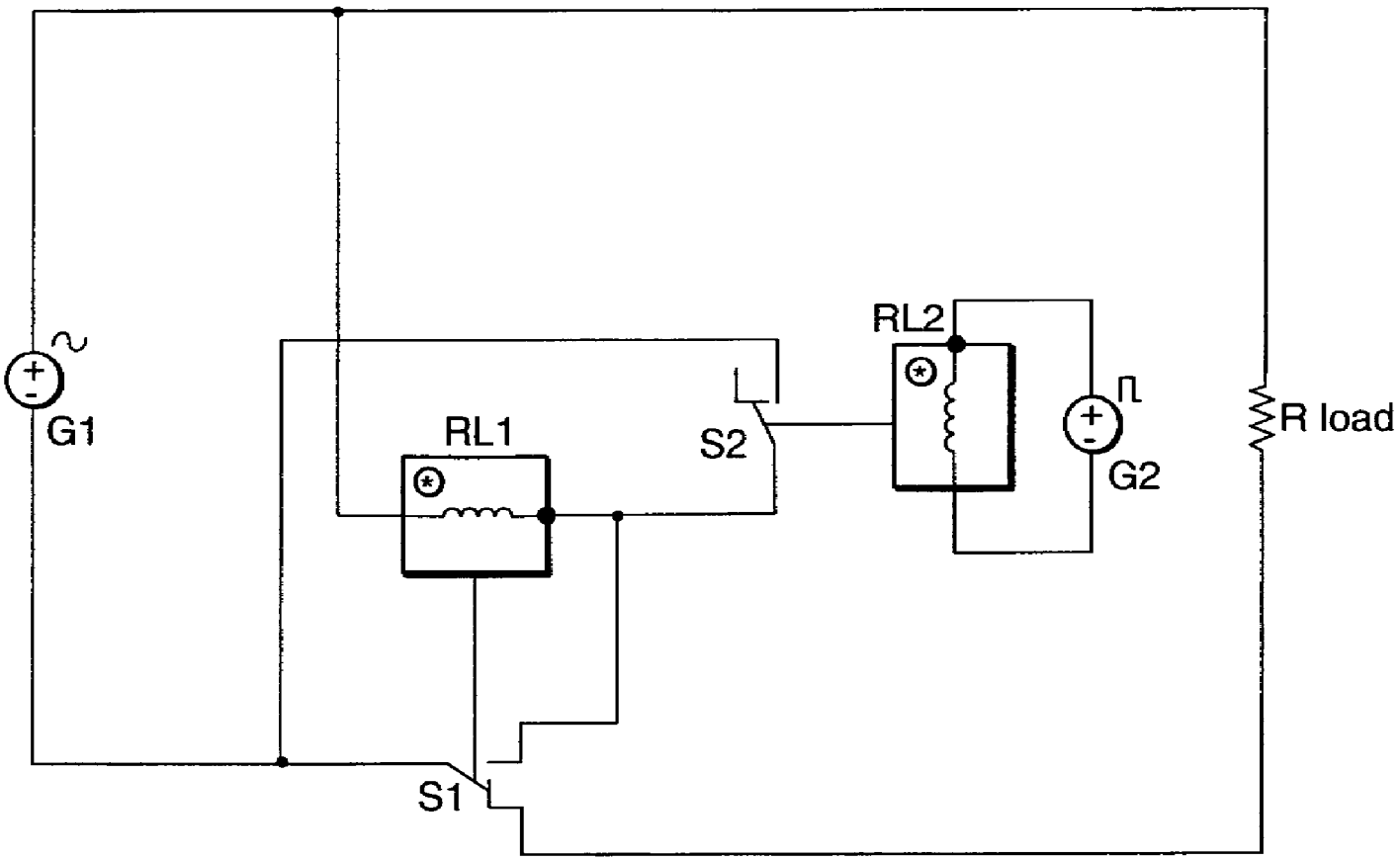
Fig. 2 PRIOR ART
FIG. 2 shows a schematic circuit diagram of a self-retaining circuit of the state of the art.

In FIG. 2, an electrical relay circuit as known from the state of the art is shown. A first relay RL1 has a first relay switch S1, which is shown in a first (default) position, in which a load circuit is closed. A load current, provided by a first generator G1, runs through R load and S1. Generator G1 provides a DC voltage here.

In the situation shown in FIG. 2, the first relay RL1 is in a currentless state. The right hand side of RL1 is not connected to the first generator G1, since both relay switches S1 and S2 are in disconnecting positions, which are their default positions.

The first relay RL1 may be powered by the first generator G1, when the second relay switch S2 of a second relay RL2 is in a magnetized, second position. The second relay RL2 may be magnetized by means of a signal pulse of a second generator G2. Then first relay RL1 is current-carrying, and S1 switches to the upper, magnetized position. Then RL1 is provided with current via S1, and S1 stays in the magnetized position.

However, the shown electric relay circuit needs two relays RL1, RL2 and thus switching contacts. Further, it is sensitive to variations of the generator voltage of G1. If, e.g., RL1 is adapted to a high voltage of G1 with an upstream resistor, a decrease of the generator voltage may cause a drop of the voltage at RL1 below its switching level.

The invention claimed is:

1. Electrical relay circuit with a self-retaining relay, comprising a load circuit with a series connection of a first generator, a load component and a relay switch of the relay, wherein the relay switch has a closed position in which the load circuit is closed, with the closed position belonging to a currentless state of the relay, wherein the relay switch is pre-stressed towards the closed position, and wherein the relay switch has a magnetized position in which the load circuit is broken, with the magnetized position belonging to a current-carrying state of the relay, further comprising an auxiliary circuit with a second generator for providing a control signal, wherein by means of the control signal the relay switch can be switched into the magnetised position, and wherein the auxiliary circuit keeps the relay switch in the magnetized position after the control signal is over, wherein the first generator is connected to a series connection of the relay and a constant current source in both positions of the relay switch, wherein the constant current source allows the flow of a constant current through it when in an activated state, wherein the constant current source is connected to an activation circuit comprising the second generator, wherein the constant current source can be put into the activated state by the activation circuit when the relay switch is in the closed position, and wherein the constant current source is further connected to a holding circuit wherein the holding circuit is activated by the constant current through the constant current source, wherein the activated holding circuit keeps the constant current source in the activated state when the relay switch is in the magnetised position.

2. Electrical relay circuit according to claim 1, wherein the constant current source comprises an optical coupler connected to a resistor and the base/gate of a transistor.

3. Electrical circuit according to claim 1, wherein the activation circuit comprises an LED, coupled to an optical coupler.

4. Electrical circuit according to claim 2, wherein the optic coupler comprises a darlington circuit, with a photocell connected to the base/gate of the darlington circuit.

5. Electrical circuit according to claim 4, wherein the photocell is connected to the basis of the darlington circuit via a power transistor, in particular an npn power transistor.

6. Electrical circuit according to claim 1, wherein the holding circuit comprises a holding transistor connected to the constant current source via a resistor, with the base/gate of the holding transistor being connected to the relay via a resistor.

7. Electrical circuit according to claim 1, wherein a capacitance is connected in parallel to the auxiliary circuit.

8. Electrical circuit according to claim 1, wherein the auxiliary circuit is connected to the first generator via at least one diode.

* * * * *